US008180231B1

(12) United States Patent
DiRubio et al.

(10) Patent No.: US 8,180,231 B1
(45) Date of Patent: May 15, 2012

(54) TESTING TRANSFER NIPS OF PRINTING DEVICES USING TRANSFER FIELD UNIFORMITY MAPS

(75) Inventors: Christopher A. DiRubio, Webster, NY (US); Charles H. Tabb, Penfield, NY (US); Michael A. Fayette, Penfield, NY (US); John S. Facci, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 33 days.

(21) Appl. No.: 12/945,942

(22) Filed: Nov. 15, 2010

(51) Int. Cl.
*G03G 15/00* (2006.01)

(52) U.S. Cl. ..... 399/31

(58) Field of Classification Search ..... 399/10, 399/15, 31

See application file for complete search history.

(56) References Cited

U.S. PATENT DOCUMENTS

| | | | |
|---|---|---|---|
| 4,803,872 | A | 2/1989 | Crawford et al. |
| 6,032,004 | A | 2/2000 | Mirabella, Jr. et al. |
| 6,160,969 | A * | 12/2000 | Ishigaki et al. |
| 7,151,248 | B2 | 12/2006 | Harush et al. |
| 7,242,875 | B2 | 7/2007 | Jones et al. |
| 2006/0222387 | A1 * | 10/2006 | Burry et al. |
| 2010/0067960 | A1 | 3/2010 | Jackson |

FOREIGN PATENT DOCUMENTS

| | | |
|---|---|---|
| JP | 2006017800 | 1/2006 |
| JP | 2007086811 | 4/2007 |

* cited by examiner

*Primary Examiner* — Susan Lee
(74) *Attorney, Agent, or Firm* — Gibb & Riley, LLC

(57) ABSTRACT

A method and apparatus can, while operating a printing device in a test mode, supply a changed transfer field to a marking material transfer device. The changed transfer field is less than or more than the standard transfer field. The method and apparatus disable operations of other marking material transfer devices of the printing device to isolate the marking material transfer device. Further, the method and apparatus compare the actual amount and/or spatial distribution of marking material transferred to a recipient surface (to which the first marking material transfer device transfers the marking material) against a predetermined standard. Then, if the actual amount of marking material transferred to the recipient surface is different than the predetermined standard, the method and apparatus can identify the first marking material transfer device as being a potential source of printing defects.

20 Claims, 7 Drawing Sheets

TESTING TRANSFER NIPS OF PRINTING DEVICES USING TRANSFER FIELD UNIFORMITY MAPS

BACKGROUND

Embodiments herein generally relate to testing printing devices, and more particularly to systems and methods that isolate transfer nips and amplify potential irregularities of transfer nips to identify potentially faulty transfer nips.

Non-uniform transfer fields within the transfer nips of printers can lead to objectionable print quality defects such as streaks, bands, mottle, within-process and cross-process color or optical density shifts (poor macro-uniformity), deletions, and other point defects. When these print quality defects are observed, it can be difficult to diagnose which subsystem or component is responsible. In a tandem engine, where there are four first transfer nips for image building on the intermediate transfer belt (ITB) and one second transfer nip for transferring the image to the substrate, it can be difficult to assess which of the 5 or more transfer nips are responsible for a transfer specific defect. This problem is conventionally solved using trial and error and good judgment.

SUMMARY

An exemplary method embodiment herein can operate a printing device in a standard operating mode. While operating the printing device in the standard operating mode, the method supplies a standard transfer field to a first marking material transfer device (e.g., a transfer nip) of the printing device. The transfer field ($E_{TRANSFER}$ in V/μm) is typically generated by operating the high voltage power supply that is attached to the transfer device in either constant current or constant voltage mode, depending on the details of the design of the transfer nip.

The method herein can also operate the printing device in a test mode. While operating the printing device in the test mode, the method supplies either a reduced or increased transfer field to a first marking material transfer device (e.g., transfer nip). The reduced/increased transfer field is less/more than the standard transfer field (e.g., 10%, 25%, 50%, etc., lower/higher voltage or current). In other words, the reduced/increased transfer field comprises operating the high voltage power supply at a voltage or current sufficiently reduced/increased to amplify electrical field variation (e.g., spatial variation) within the marking material transfer device.

Further, while operating the printing device in the test mode, the method compares the actual amount of marking material transferred to a recipient surface and its spatial distribution (i.e., spatial uniformity) against a predetermined standard. The recipient surface comprises one to which the first marking material transfer device transfers the marking material, such as a transfer belt, a sheet of print media, etc. This comparing process detects the actual amount of marking material transferred to the recipient surface and, more importantly, its spatial distribution using, for example, an optical scanner. Thus, if the spatial distribution of the marking material transferred differs from the predetermined standard spatial distribution, the method can identify the first marking material transfer device as being a potential source of printing defects. Often, the optimal performance will be achieved when there is no spatial variation in the amount of marking material, since this represents a condition in which there is no spatial variation in the transfer field. A spatially uniform transfer field is most likely to generate a spatially uniform image when the transfer device is returned to its normal operating mode.

Additionally, while operating the printing device in the test mode, the method can disable or partially disable operations of other marking material transfer devices of the printing device to isolate the activities of the first marking material transfer device. For example, the downstream transfer devices in a tandem engine (FIG. 1) could be operated at sufficiently low transfer fields to avoid retransfer scavenging of the toner transferred by the transfer device under test to the image receiving surface. Also, while operating the printing device in the test mode, the method can repeat the supplying of the reduced transfer field, the disabling process, the comparing process, and the identifying process (individually for each of the other marking material transfer devices) to identify ones of the other marking material transfer devices as being potential sources of printing defects.

A printing device embodiment herein comprises a processor, and a marking material supply operatively connected to (directly or indirectly connected to) the processor. The marking material supply maintains marking material. A media sheet supply is also operatively connected to the processor. The media sheet supply maintains at least one media sheet to which the marking material will be transferred. Further, one or more marking material transfer devices can be operatively connected to the processor. The marking material transfer devices directly or indirectly transfer the marking material to the media sheet.

The processor can control the printing device to operate in a standard operating mode. As shown above, while operating the printing device in the standard operating mode, the processor supplies a standard transfer field to a first marking material transfer device of the marking material devices.

Also, the processor can control the printing device to operate in a test mode. Again, while operating the printing device in the test mode, the processor supplies either a reduced or increased transfer field to the first marking material transfer device. The reduced/increased transfer field again is either above or below the standard transfer operating field. While operating the printing device in the test mode, the processor can disable or partially disable operations of other ones of the marking material transfer devices. In practice it may be more typical to run the transfer device at lower then optimal fields when in test mode.

Further, while operating the printing device in the test mode, the processor compares the spatial distribution of marking material transferred to a recipient surface (to which the first marking material transfer device transfers the material) against a predetermined spatial distribution standard using, for example, an optical scanner. If the actual amount and, more importantly, the spatial distribution of marking material transferred differs from the predetermined spatial distribution standard, the processor identifies the first marking material transfer device as being a potential source of printing defects.

Similarly, to that shown above, while operating the printing device in the test mode, the processor can repeat the supplying of the reduced transfer field, the disabling process, the comparing process, and the identifying process (individually for each of the other marking material transfer devices) to identify ones of the other marking material transfer devices as being potential sources of printing defects. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, it can be difficult to assess which of the many transfer nips within a printing device are responsible for a transfer specific defect. This problem is conventionally solved using trial and error and good judgment. The embodiments herein use Transfer Field Uniformity Maps (TFUMs) to help diagnose and anticipate print quality failure modes.

Many image transfer failure modes are associated with spatially non-uniform transfer fields. Transfer field non-uniformity leads to objectionable image and color non-uniformity at all length scales, including: point defects, graininess (sub-mm variation), mottle (~mm variation), macro-uniformity variation (>cm variation), streaks (continuous or time/position varying), and bands.

Consider the case of a 4-color tandem printing engine with 5 total transfer nips using biased transfer rollers or other conformable biased transfer technologies. The transfer field is generated by applying high voltage to a conformable electrode in the transfer nip (e.g., a biased transfer roller). Under normal operating conditions, the bias is chosen to insure that the toner transfer efficiency is high and very insensitive to variations in the transfer field (see FIG. 2).

However, with embodiments herein, in diagnostic mode a transfer field uniformity map is generated by running the transfer bias at a much lower level, where the transfer efficiency, and therefore the print optical density, is much more sensitive to variations in the spatial uniformity of the transfer field. By doing so, any variations in transfer field will be amplified dramatically, enabling quick diagnosis of the operating conditions and components within each transfer nip.

The transfer field uniformity maps can be sensed using any form of optical sensor, such as full-width array scan bars (to evaluate the image on the intermediate transfer belt (intermediate transfer belt), paper, or other media sheet, etc.) or multiple point sensors within the engine. Alternatively, the final diagnostic print can be manually sensed visually (by the user) or with a scanner that may be attached to the print engine itself.

Figure 1:
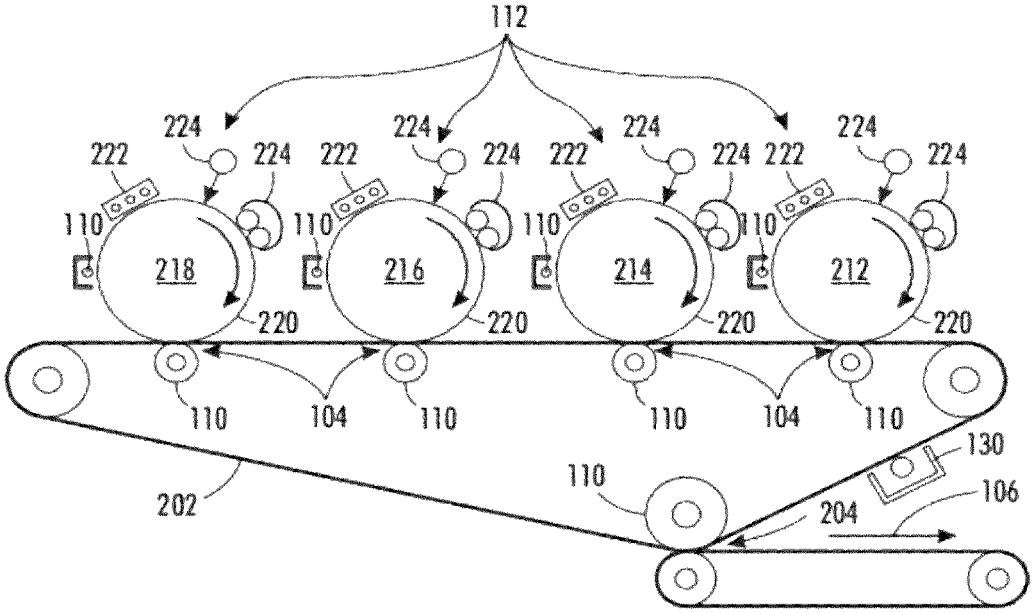
FIG. 1 is a side-view schematic diagram of a device according to embodiments herein.

While the embodiments herein are applicable to any marking architecture, one example that can illustrate the embodiments herein is a tandem Intermediate Belt Transfer (IBT) architecture. An example of this architecture is illustrated in FIG. 1.

While the marking material transfer units 104, 204 are sometimes referred to herein as transfer "nips" formed between two rollers, as would be understood by those ordinarily skilled in the art, the marking material transfer units 104, 204 herein can comprise any device that transfers marking material from one surface to another, including mechanical devices, electrical devices, and electro-mechanical devices.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Patent Publication 2010/0067960, the complete disclosure of which is fully incorporated herein by reference. The embodiments herein can encompass embodiments that print in color, monochrome, or handle color or monochrome image data. All embodiments are specifically applicable to electrostatographic machines and/or processes.

A full process color image output terminal (TOT) assembly, includes an intermediate transfer belt or image receiving and carrying member 202, and a first series of components 210 for forming and transferring full process color images onto the intermediate image receiving and carrying member 202. The print engines 112 include drum-based YMC image output terminals 212, 214, 216, and a K (black) image output terminal 218. The image output terminals 212, 214, 216, 218 form the full process color image on the intermediate transfer belt 202. Each image output terminal 112 includes an image bearing member 220, a charging device 222, exposure device 224, development device 226, and cleaning devices 228 for forming a separate toner image on the image bearing member 220 for transfer onto the intermediate transfer belt or image receiving and carrying member 202.

As shown in FIG. 1, an image is built on an intermediate transfer belt (ITB) 202 using four marking units 112. Each of the marking units 112 applies a different separation (e.g., color or tone (e.g., yellow, magenta, cyan, black (Y,M,C,K)) of marking material (ink, toner, etc.) to the transfer belt 202 using "first transfer" nips 104. Thus, one separation (e.g., color or tone) of marking material is applied to the belt 202 at a time. The 4-color image is then transferred from the belt 202 to a sheet of media 106 (e.g., paper, transparencies, etc.) that is traveling along the paper path by the second transfer nip 204. An intermediate transfer belt cleaner is shown as item 130.

Figure 2:
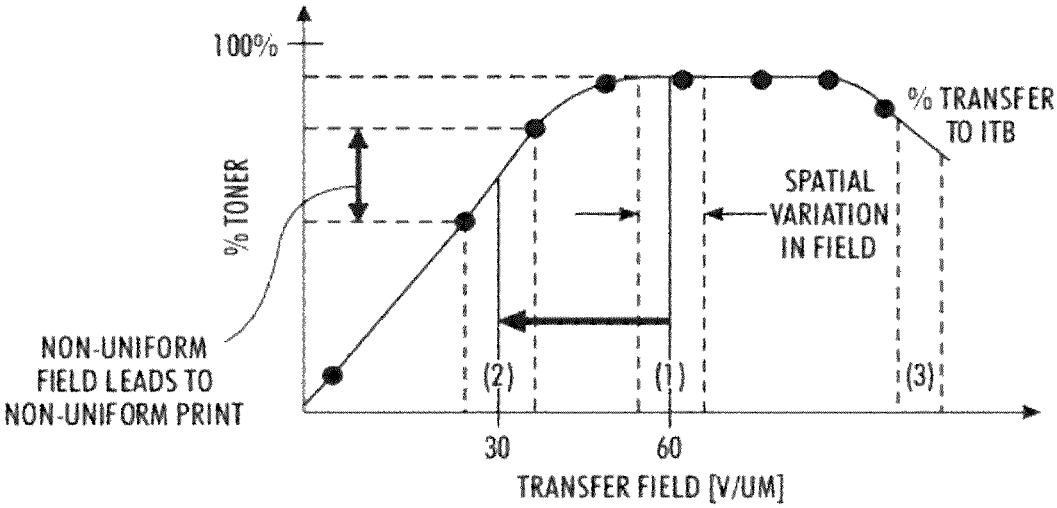
FIG. 2 is a chart illustrating aspects of embodiments herein.

The transfer field is usually generated by applying a high voltage bias to the shaft of the bias transfer roll (BTR) 110 located on the inside of the intermediate transfer belt, opposite the photoreceptor. The high voltage bias may be operated in either constant current mode or constant voltage mode, depending on the details of the design of the transfer nip. Therefore the transfer field is controlled indirectly by controlling either the voltage or the current supplied by the high voltage power supply. The fraction of the toner transferred from the developed image on the photoreceptor to the intermediate transfer belt is illustrated graphically by the "% transfer to ITB curve" in FIG. 2. As shown in FIG. 2, under normal operating fields at, for example 60V/μm (spatial variation region (1)) the transfer efficiency (indicated by solid vertical lines) is very insensitive to spatial variation in the transfer field (variation indicated by dotted vertical lines).

A full-page single separation halftone print from the marking station is very spatially uniform at, for example, 60V/μm. If, however, the transfer field is changed by adjusting the power supply to a voltage or current above or below the flat insensitive region (from spatial variation region (1) to spatial variation region (2), in FIG. 2) then the transfer efficiency, and therefore the toner density transferred to the intermediate transfer belt, is very sensitive to spatial variation in the transfer field. Likewise, if the transfer field is increased to a level above the spatially uniform region (for example to region 3 in FIG. 2), the toner density transferred to the belt will be very sensitive to spatial variation in the transfer field.

Thus, as shown in FIG. 2, at optimal transfer fields, potential spatial non-uniformities would not be easy to detect because the optimal fields keep the transfer image density uniform (flat region of the % transfer to ITB curve shown in FIG. 2). Thus, at optimal fields (e.g., 60V/μm) a transfer field spatial variation within the transfer nip would result in very little change in the percentage of toner transferred, as shown by spatial variation region (1) of the % transfer to ITB curve in FIG. 2.

However, if the transfer field is changed to a point on the % transfer to ITB curve in FIG. 2 that is not flat (is sloped), potential spatial non-uniformities are much easier to detect. Thus, at different fields (e.g. 30V/μm) a transfer field spatial variation within the transfer nip would result in a large change in the percentage of toner transferred (e.g., 10%, 25%, 50%, etc.) as shown by region (2) in FIG. 2 where the non-uniform field leads to non-uniform printing. The different fields therefore amplify any potential non-uniformities that may be produced by a given transfer nip, allowing users and/or sensors to more easily detect such differences in the amount of marking material transferred by the transfer nip. Likewise, the transfer field could be increased to the sloped region above ~80 V/μm to sense and amplify the spatial non-uniformites in the field.

A transfer field uniformity map (such as that shown in FIG. 3) can be generated for any of the transfer nips by changing the applied transfer field until the transfer device is operating in the sloped region of the % transfer to ITB curve (spatial variation region (2 or 3) in FIG. 2). The exemplary transfer field uniformity map 300 shown in FIG. 3 was made with a magenta transfer nip. A long edge feed (process direction top to bottom) full page halftone print (area coverage ~60%) was generated at a low transfer field and sensed at position T2 in FIG. 4.

The variation in the density of the print in the cross-process direction is due to lower fields in the center of the transfer nip relative to the inboard and outboard edges. The bias transfer roll 110 nip width variation leads to transfer field variation in the cross process direction. For example, with a wide nip, the higher transfer fields produce darker images 302 near the inboard and outboard edges. However, a narrow nip leads to lower transfer fields and a lighter image 304 in the center. This field variation can lead to the color shifts in the cross process direction during normal printing operation that are due to spatially non-uniform retransfer scavenging to downstream first transfer nips. This is particularly noticeable when printing multi-color images. For example, consider the case of a red image. In the first two transfer nips yellow and then magenta toner are transferred to the intermediate transfer belt (ITB). This transfer will be spatially uniform (optimal region of FIG. 2). In the two downstream nips (cyan and black) no additional toner is transferred to the red image element, but magenta toner from the top of the red image can be scavenged from the ITB and retransferred to the photoreceptor. The scavenged magenta toner results in a color shift of the red image element. If the transfer fields are spatially non-uniform in the cyan and black nips, then more magenta toner will be scavenged from the high field regions (say the inboard and outboard edges) than the low field regions, and therefore there will be a variation of the color of a red image element depending on where it is located in the page. This defect is sometimes referred to as "retransfer smile". The higher fields (for example in the inboard and outboard edge) result in more air breakdown in the toner pile, which creates wrong sign, positively charged toner near the top of the pile. This wrong sign toner is pulled towards the photoreceptor, leading to enhanced retransfer scavenging.

Field variation in the process direction that repeats at a distance equal to the circumference of the biased transfer roller 306 indicates non-uniformity in the electrical or mechanical properties of the bias transfer roll 110. Several low field defects in the sample transfer field uniformity map 300 repeat at this spatial frequency.

The embodiments herein also measure and evaluate the spatial uniformity of the density of the marking material (image) transferred to the substrate. Here, the substrate could be the intermediate transfer belt 110 (to evaluate first transfer) and/or a sheet of media 106 (to evaluate first and/or second transfer). The amount of marking material transferred to the substrate is sometimes referred to herein as the transfer image density (TMA) (transferred mass per unit area).

There are several sensor options for sensing transfer field uniformity maps (TFUMs). Full width array (FWA) imaging bars would provide data that could be used to find spatially small transfer field variations such as the repetitive point defects 306 illustrated in FIG. 3. A less expensive array of point sensors located at different points in the cross-process direction could be used to detect larger scale cross-process field variation, like that expected from retransfer smile 306 (see FIG. 3). The retransfer smile defect (color variation in the cross-process direction) is caused by cross-process transfer field variation. Point image/toner density sensors are already routinely used in color engines to monitor the TMA (transferred mass per unit Area) at position T1 in FIG. 4. These sensors include the ETACS (Enhanced Toner Area Coverage Sensors) available from, for example, Xerox Corporation, Norwalk, Conn., USA.

Figure 4:
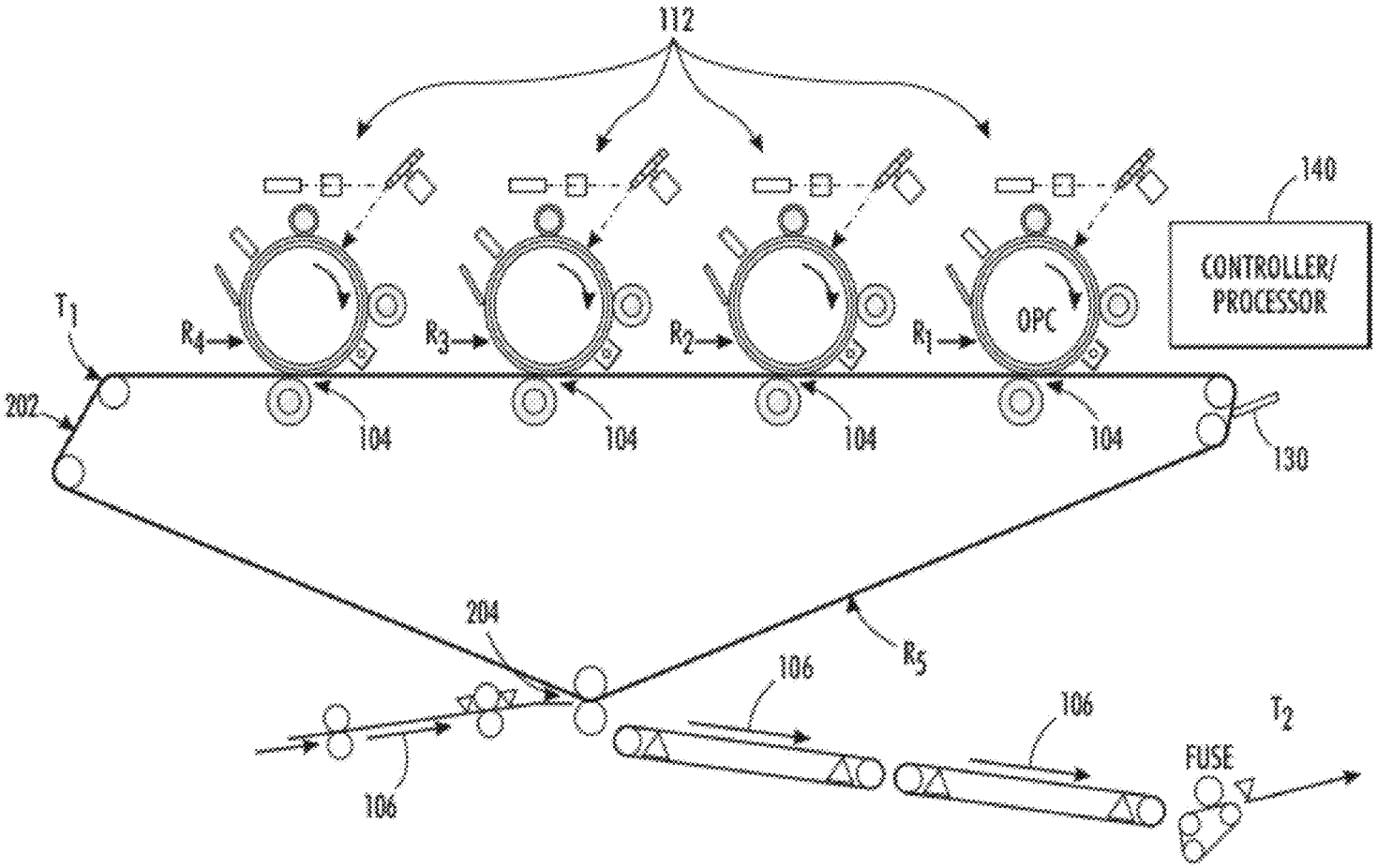
FIG. 4 is a side-view schematic diagram of a device according to embodiments herein.

The embodiments herein evaluate the density of the toner remaining on the image bearing member (photoreceptor, transfer belt, media sheet, etc.) using various sensors. FIG. 4 illustrates some exemplary transfer sensors T1 and T2. The embodiments herein can measure the amount of marking material that has been transferred to the image bearing members, using transfer sensors T1 and T2, or can measure the amount of marking material remaining on the photoreceptor (R1,R2,R3,R4) or Intermediate transfer belt (R5) after the transfer nip has transferred the marking material using residual mass sensors R1, R2, R3, R4, R5 in FIG. 4. This second measure of the amount of marking material remaining on the photoreceptor is sometimes referred to as the residual image density or the RMA (Residual Mass per unit Area), and the RMA can be measured using sensors residual R1, R2, R3, R4, R5 in FIG. 4.

Further, FIG. 4 illustrates a controller/processor 140 that is operatively connected to the various transfer and residual sensors (T1, T2, R1-R4, etc.). The connections between the controller 140 and the various sensors are not illustrated in the drawings to avoid clutter. As would be understood by those ordinarily skilled in the art, the controller/processor 104 includes an integrated circuit logic device (e.g., at least one processor chip), a power supply, a non-transitory computer-readable data storage medium, electrical connections, physical connections, etc.

Where the current embodiment is evaluating the transfer image density at reduced transfer fields (region 2 in FIG. 2) using transfer sensors T1 and T2, high field regions will have higher toner densities and will appear darker on the final image, and low field regions will appear lighter. To the contrary, where this embodiment evaluates the residual image density using residual sensors R1-R5, high field regions will have lower toner density (better transfer efficiency) and low field regions will have higher toner density. The reverse is true if the embodiment is operated in the very high field region (region 3 in FIG. 2), i.e. T1 and T2 will register lower densities in high field regions and R1-R5 will register higher densities in low field regions.

Potential locations for image density sensors in a 4-color tandem marking engine are indicated in FIG. 4, although as would be understood by those ordinarily skilled in the art, any number of marking engines and sensors at different locations could be used with embodiments herein. As mentioned above, the residual image density on the image bearing member could be measured at any of the residual sensors R1, R2, R3, R4, and/or R5. The first four locations measure the residual mass on the photoreceptors after "first transfer" nips (transfer from photoreceptor to intermediate transfer belt). Residual sensor R5 measures the residual image density on the intermediate transfer belt after the "second transfer" nip (transfer from intermediate transfer belt to paper/substrate).

Figure 3:
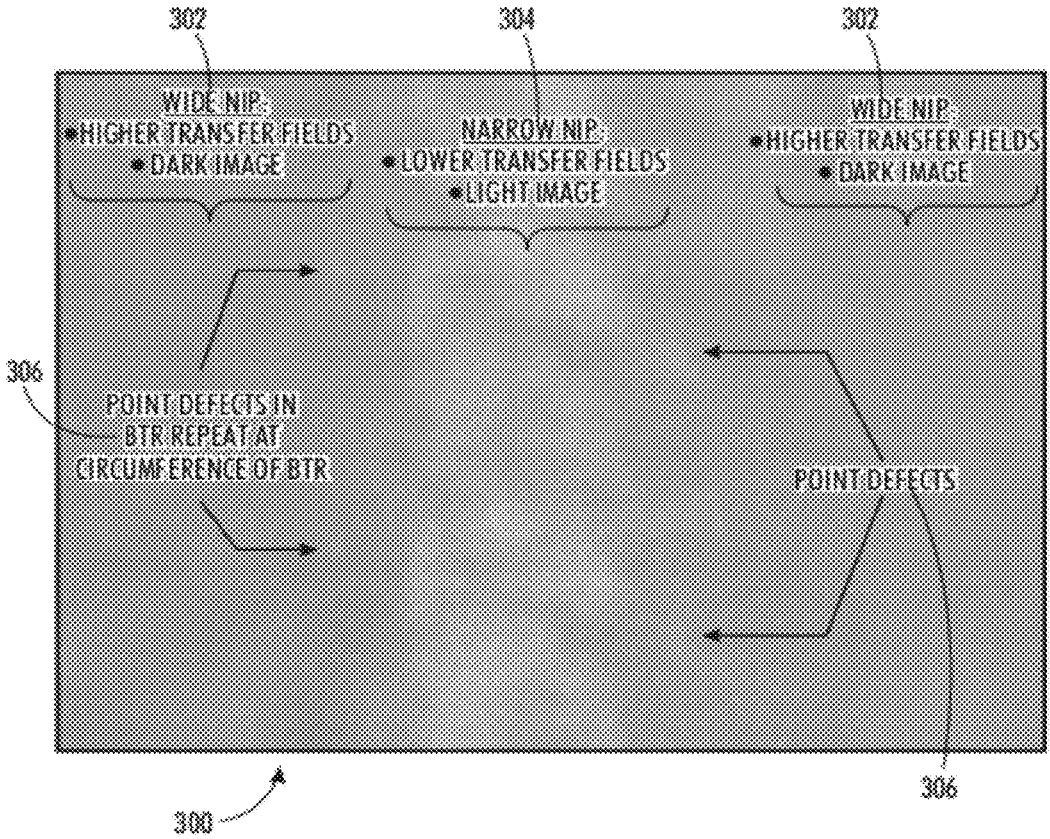
FIG. 3 is a schematic diagram of a transfer field uniformity map according to embodiments herein.

To the contrary, transfer sensor T1 measures the transfer image density on the intermediate transfer belt after the first transfer nips 104. In different embodiments, additional transfer image density sensors are also employed between the first transfer nips 104. A transfer image density sensor T2 can be used to directly measure the image density of the image on the substrate (media sheet) either before or after fusing. FIG. 3 represents a transfer field uniformity map image for the magenta nip image measured at sensor location T2 after fusing.

While many sensors are discussed above, in some embodiments, a single transfer image density sensor (or sensor array) can be used (e.g., transfer sensor T2) to measure and evaluate transfer field uniformity maps for all 5 transfer nips (104, 204). Likewise a single transfer sensor T1 (or sensor array) can be used to assess all of the first transfer nips 104.

To generate a transfer field uniformity map in the first nip, one of the marking engines 112 can be activated to produce an image (e.g., a yellow image) on the corresponding photoreceptor and the corresponding transfer nip is operated at, for example, a relatively lower transfer field (sloped region (2) in FIG. 2). The other first transfer devices 104 are operated at minimal electrical fields (i.e. partially disabled) to minimize retransfer scavenging of the toner from the intermediate transfer belt to the photoreceptor (because non-uniform retransfer scavenging could otherwise induce spurious non-uniformities in the transfer field uniformity map). The second transfer nip 204 would be operated at normal (relatively higher) transfer fields, and the transfer field uniformity map would be evaluated on the substrate by the transfer sensor(s) T2. Therefore, a transfer field uniformity map can be generated for any of the first transfer nips by producing an image at nip n (e.g., a full page halftone (or other) image) operating the transfer device at nip n at lower transfer field (sloped region (2) in FIG. 2). Likewise the transfer field uniformity map could be generated by operating nip n at a higher field than optimal.

Additionally, a transfer field uniformity map for the second transfer nip 204 can be generated by operating the transfer device 204 at the lower transfer field (sloped region (2) in FIG. 2) while operating the first nips 104 at the standard, higher voltage. Transfer device 204 is measured/evaluated using transfer sensor T2 (transfer image density) or residual sensor R5 (residual image density). Likewise the transfer field uniformity map could be generated by operating transfer device 204 at a higher field than optimal.

Figure 5:
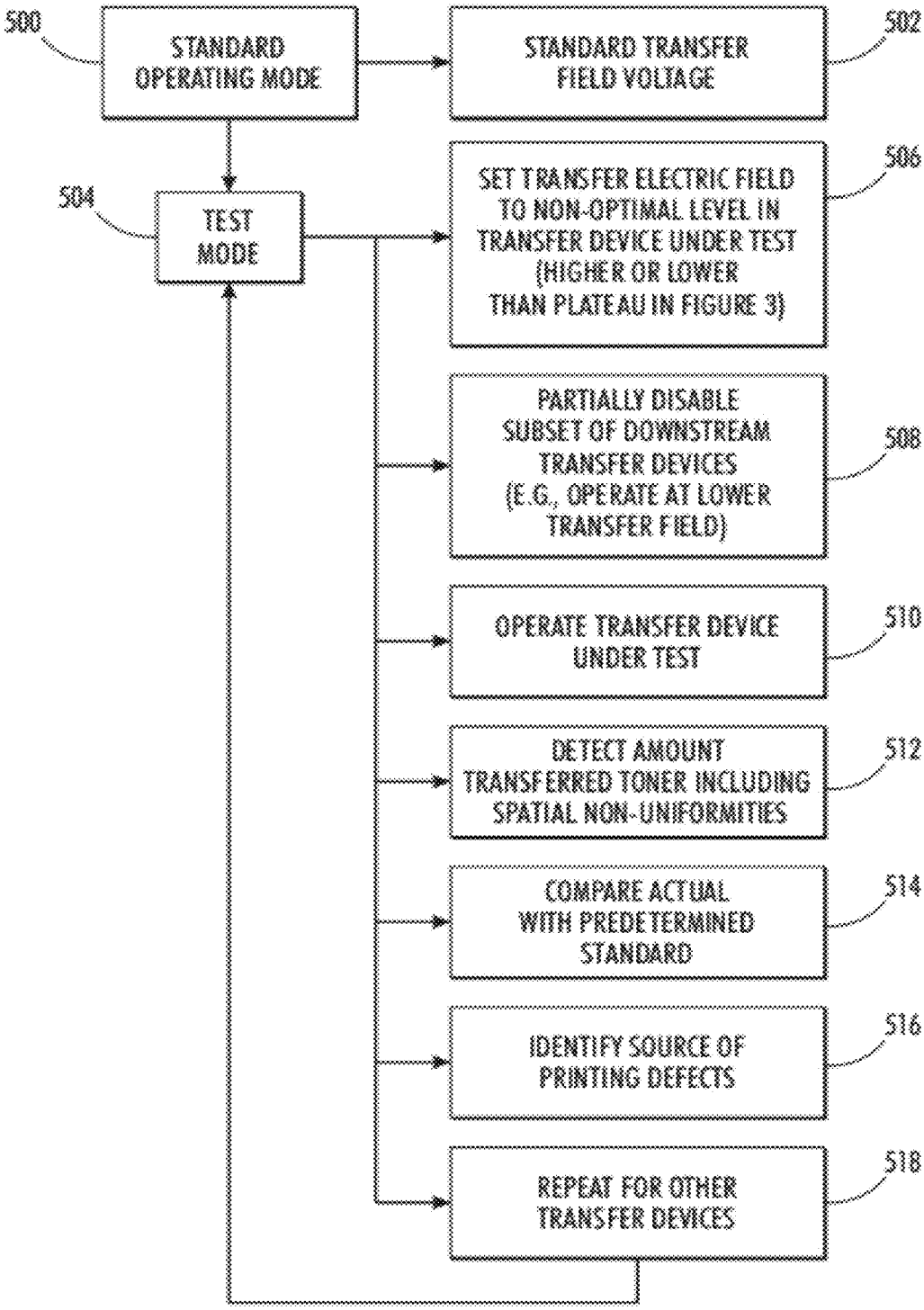
FIG. 5 is a flow diagram illustrating embodiments herein.

An exemplary method embodiment is shown in FIG. 5. As indicated in item 500, the embodiments herein can operate a printing device in a standard operating mode 500. While operating the printing device in the standard operating mode, the method supplies a standard transfer field to a first marking material transfer device (e.g., a transfer nip) of the printing device in item 502.

The method herein can also operate the printing device in a test mode in item 504. While operating the printing device in the test mode, the method supplies a changed, non-optional (reduced or increased) transfer field to the first marking material transfer device (506). The non-optimal transfer field is either less than or greater than the standard transfer field (e.g., 10%, 25%, 50%, etc., lower/higher transfer field). In other words, the non-optimal transfer field comprises a field sufficiently different (reduced or increased) to amplify electrical field inconsistencies (e.g., spatial inconsistencies) within the marking material transfer device.

Further, while operating the printing device in the test mode, the method can disable or partially disable operations of other marking material transfer devices of the printing device to isolate the activities of the first marking material transfer device in item 508. The method then operates the first marking material transfer device to cause the first marking material transfer device to transfer the marking material to the recipient surface in item 510. The recipient surface comprises one to which the first marking material transfer device transfers the marking material, such as a transfer belt, a sheet of print media, etc.

Figure 6:
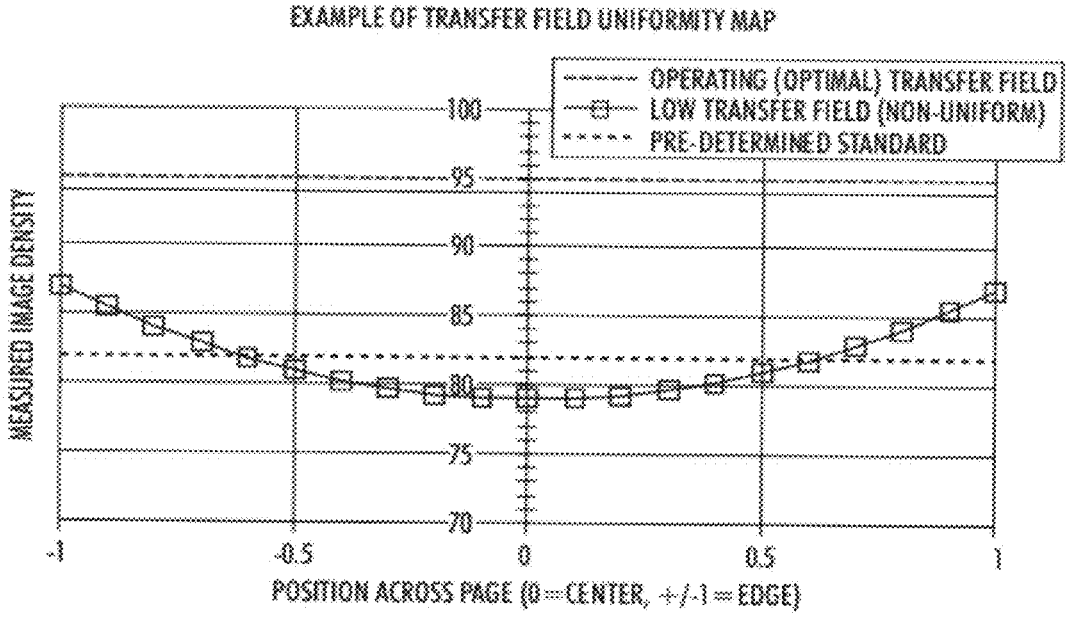
FIG. 6 is a chart illustrating aspects of embodiments herein.

This process then detects the actual amount of marking material transferred to the recipient surface using, for example, an optical scanner in item 512. The method compares the actual amount of marking material transferred to a recipient surface against a predetermined standard 514. Thus, in item 516, if the spatial variation and/or actual amount of marking material transferred differs from or does not match the predetermined spatial variation standard, the method can identify the first marking material transfer device as being a potential source of printing defects. This is illustrated in FIG. 6, where the spatial distribution of the transferred toner is plotted as a function of position in the cross process direction (e.g., from inboard to center to outboard). In standard operating 500 mode, the transfer efficiency is high and very spatially uniform 550. In this example, in test mode 504, the transfer field is reduced 506 and the transfer field uniformity map that is measured 512 is highly non-uniform 552. The transferred toner density is higher on the inboard and outboard edges of the process than it is in the center, indicating higher transfer fields near the edges. The pre-determined standard 514 calls for a spatially uniform transfer field uniformity map 554. If the measured TFUM 552 is significantly different than the pre-determined standard 554, then this transfer device fails the test and corrective action may be taken.

Additionally, as shown by item 518, while operating the printing device in the test mode, the method can repeat the supplying of the reduced transfer field, the disabling process, the comparing process, and the identifying process (individually for each of the other marking material transfer devices) to identify ones of the other marking material transfer devices as being potential sources of printing defects.

Figure 7:
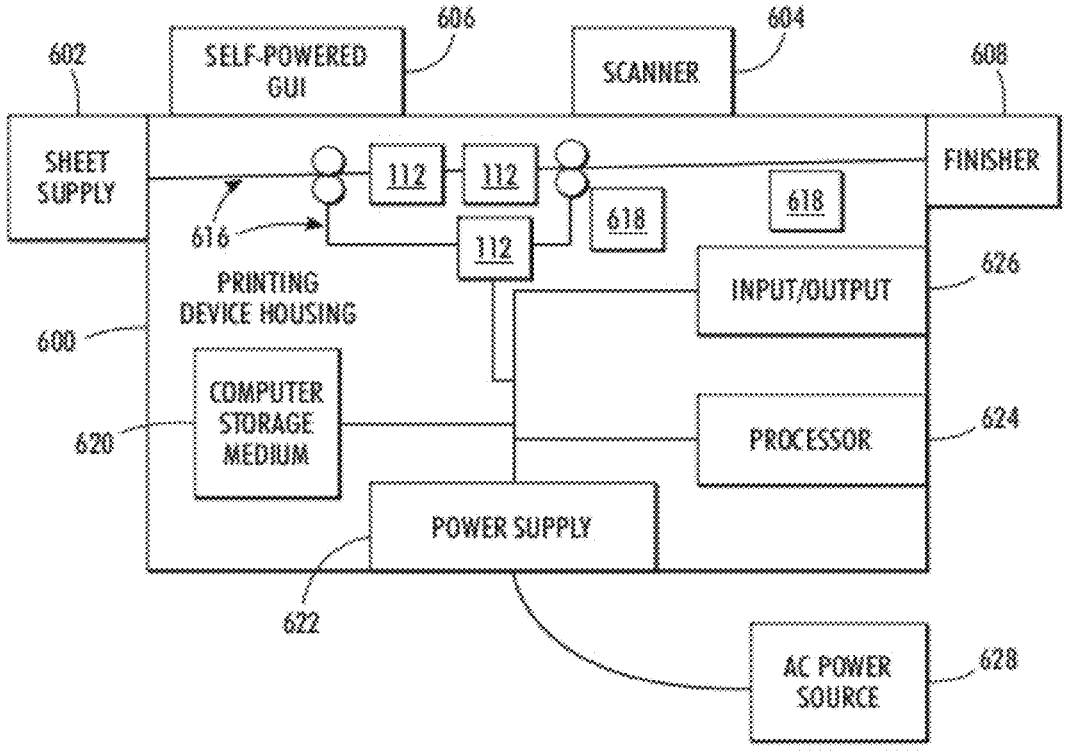
FIG. 7 is a side-view schematic diagram of a device according to embodiments herein.

FIG. 7 illustrates one exemplary multi-function printing device, according to embodiments herein. Such a device comprises a printer body housing 600 having one or more functional components such as printing engines 112 that operate on the external power source 628. Further, the printing device includes at least one accessory functional component (such as a scanner 604, sheet supply 602, finisher 608, etc.) and graphic user interface assembly 606.

In the multi-function printing device shown in FIG. 7, sheets of media are supplied from a sheet supply 602 along a paper path 616 to the various printing engines 112. After receiving various markings from the printing engines 112, the sheets of media pass to a finisher 608 which can fold, staple, sort, etc., the various printed sheets. Further, the various sensors (T1, T2, R1-R5, etc.) that are used to produce the transfer field uniformity map are illustrated as items 618.

An input/output device 626 is used for communications to and from the multi function printing device 600. A processor 624 controls the various actions of the printing device. A non-transitory computer storage medium 620 (which can be optical, magnetic, capacitor based, etc.) is readable by the processor 624 and stores instructions that the processor 624 executes to allow the multi-function printing device to perform its various functions, such as those described above. The power supply 622 connects to an external alternating current power source 628 and converts the external power into the type of power needed by the various devices mentioned above.

Figure 8:
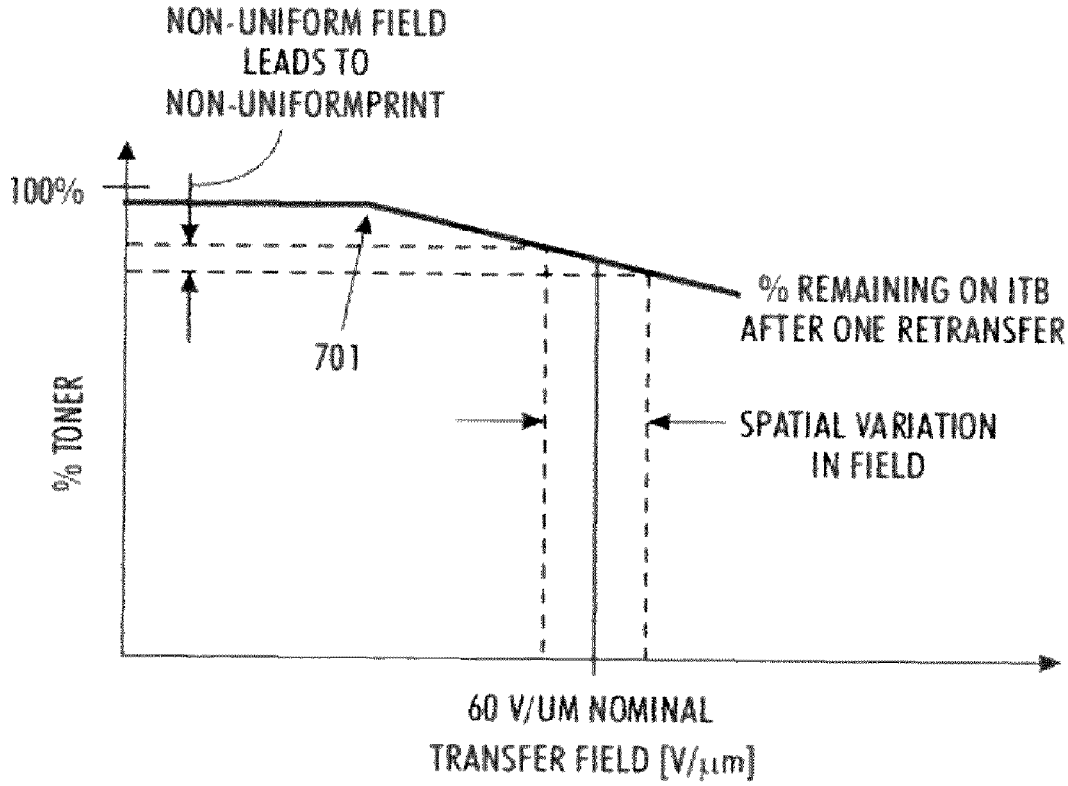
FIG. 8 is a chart illustrating aspects of embodiments herein.

As shown in the chart in FIG. 8, an alternate embodiment herein probes the transfer field non-uniformity by directly measuring retransfer scavenging of toner from the ITB to the photoreceptors in downstream transfer device nips. In FIG. 4, there are four transfer nips [104] for transferring toner from a photoreceptor/OPC to the ITB. Retransfer scavenging can occur in the last three of these downstream nips. If there is toner on the ITB entering these nips, then FIG. 8 represents the amount of toner that remains on the ITB after retransfer scavenging by one of the downstream nips. Even at normal operating fields (e.g. 60 V/μm in FIG. 8), there is significant toner loss due to retransfer scavenging in each of the downstream nips, and, as FIG. 8 illustrates, this mass loss will be spatially non-uniform if the field is non-uniform. A transfer field uniformity map for one of these downstream nips is either sensed on the ITB (e.g sensor T1), the paper (e.g. sensor T2), or by the toner scavenged by the OPC in the nip under test (e.g., sensor R3 if the third transfer device 104 was under test). Note, that retransfer scavenging is minimized and field independent at transfer fields below the threshold field 701 for retransfer (flat part of curve below the threshold for retransfer 701 in FIG. 8).

Assume that the color order for the four OPC-to-ITB transfer nips [104] is Y,M,C, K (K stands for black). The process for measuring the third (cyan) transfer nip may look like the following 1. Transfer toner from station 1 (yellow) to the ITB;

2. Reduce the transfer field in station 2 (magenta) below the threshold for retransfer [701] so that the toner image on the ITB entering the station under test (station 3) is still spatially uniform.

a. Or alternately run station 2 at the standard transfer field and transfer magenta to the yellow already on the ITB. This red two layer image will increase the amplitude retransfer signal measured by the sensors (step 5).

3. Run station 3 at a pre-determined transfer field. While operating it at the nominal field will result in some non-uniform retransfer, the signal to noise ratio will be better if it is run at a higher transfer field than nominal.

4. Run station 4 (black) at a transfer field below the threshold for retransfer so that any retransfer mass loss is very small and spatially uniform.

5. Directly sense the toner that is scavenged by the OPC using sensor R3 or measure the toner remaining on the ITB at T1 or the toner transferred to the paper at T2.

a. Note that sensing at T2 requires the ITB-to_paper transfer nip to be operated at its nominal/standard transfer field.

The transfer field set points for testing each of the downstream nips using the retransfer method is illustrated in the table below.

Retransfer method of measuring field uniformity in OPC-to-ITB transfer nips [104]

| | Operation of transfer fields at each of the transfer nips in test mode | | | | |
|---|---|---|---|---|---|
| Nip under test | Nip 1 (Y) | Nip 2 (M) | Nip 3 (C) | Nip 4 (K) | 204 (to paper) |
| 2 (M) | Normal, transfer yellow to iTB | well above retransfer threshold | Below retransfer threshold | Below retransfer threshold | standard, nominal field |
| 3 (C) | Normal, transfer yellow to iTB | Below retransfer threshold | well above retransfer threshold | Below retransfer threshold | standard, nominal field |
| 4 (K) | Normal, transfer yellow to iTB | Below retransfer threshold | Below retransfer threshold | well above retransfer threshold | standard, nominal field |

Although this retransfer method is best suited to the "downstream OPC-to-ITB transfer nips [104] 2, 3, and 4, it could also be used for nip 1 by operating the engine in a two-pass mode. To be more specific: (1) transfer a color, say black, to the ITB in pass 1, (2) on pass 2 open the second transfer nip so the image remains undisturbed on the ITB and is not transferred to the paper, (3) cam out the ITB cleaner nip [130] so the image passes the cleaner undisturbed, (4) on the second pass, operate the first OPC_to_ITB transfer nip (yellow) at a high field to generate the TFUM, (5) option 1: sense the TFUM on the station 1 OPC with sensor R1, (6) operate stations 2,3,4, etc. at a transfer field below the threshold for retransfer [701], (7) option 2: sense the Transfer Field Uniformity Map on the ITB at sensor T1, (8) transfer the image to paper at the standard operating field [204], (9) option 3: sense the TFUM with sensor T2.

Therefore, as shown above, such automated transfer field uniformity maps can be used to diagnose the root cause of print quality defects or sub-optimal transfer performance in a marking engine. An example of a transfer field uniformity map analysis follows.

First, the transfer field uniformity map analysis can be automatically or manually triggered. A trigger that initiates an automated transfer field uniformity map analysis could include, for example, an automatically detected print quality defect. Alternatively, a customer/user, service engineer, or a system test engineer on the manufacturing line could manually initiate the trigger.

An automated trigger could be initiated by a counter (e.g., print count), an internal machine sensor (e.g., Temp, RH), or a detected print quality defect (e.g., detected with a full width array image bar) at which point the print engine would go into a diagnostic mode. Then, a transfer field uniformity map is automatically generated for each transfer nip.

The current embodiments can analyze and diagnose transfer performance. The transfer field uniformity map data is collected by the sensors and analyzed by a software routine running on the processor to identify which, if any, of the transfer nips is performing sub-optimally (e.g., generating a print quality defect). If the analysis indicates a transfer nip is performing sub-optimally, various actions can be taken to improve transfer performance. Once the actions are complete, the foregoing can be repeated to determine if the corrective actions were successful.

The actions taken might include "open loop" or "feed forward" actions, such as making an adjustment to a transfer nip actuator (control factor). The actuator may be electrical (e.g., transfer high voltage bias or current) or mechanical (e.g. nip pressure adjustment). The actuation may be either manual or automatic, and may include an action such as running an automatic cleaner over a transfer component to remove contamination. Another action could be to initiate a service call. This could be done automatically through an internet connection (remote diagnostics), or an error message could be displayed on the printer screen.

Alternatively, a "manual" action may be needed, such as replacement or cleaning of a transfer component (such as a BTR (Biased Transfer Roller)) or a transfer nip actuator may need to be adjusted to solve any problems identified by the transfer field uniformity maps. These actions might be taken by a service engineer in the field, or a system inspection engineer on the manufacturing line. For example, if the transfer field uniformity map indicated that one or more of the transfer nips exhibited the signature of a non-uniform nip width (e.g. high density inboard and outboard relative to the center that would lead to retransfer smile), then one or more bias transfer rolls may be replaced, or the nip pressure/force in one or more nips might be adjusted to make the nip width more uniform.

One benefit of embodiments herein is that, if the analysis indicates that transfer nips are performing adequately, and there is a print quality defect that still needs to be diagnosed, then transfer can be ruled out as the root cause and other diagnostic routines can be initiated to identify the source (component or subsystem) of the print quality defect(s).

Further, on the manufacturing line, the automated transfer field uniformity map routine of embodiments herein can be used in manufacturing to insure that all of the transfer nips have sufficiently uniform nips. The transfer field uniformity map routine identifies which if any transfer nips require adjustment or other action. Actions could include replacing the bias transfer roll(s) that were identified (e.g., due to out of spec elastomer crown), or adjusting the nip pressure in those nips.

During a service call, the automated transfer field uniformity map routine identifies which, if any, of the transfer nips needed adjustment or needed to have the bias transfer roll replaced. With embodiments herein, no bias transfer rolls are replaced unnecessarily.

During normal machine operation, the automated transfer field uniformity map of embodiments herein identifies transfer nips with poor nip width uniformity. In response, the printer can automatically make nip pressure adjustments or adjust other nip actuators to mitigate the problem. Alternately the printer could initiate a service call through remote diagnostics that would identify exactly which nips require attention. The engine could also send an error or warning message to the front graphic user interface of the print engine to warn the customer to take action.

In this way, the automated transfer field uniformity maps of embodiments reduce run cost by insuring that only defective parts are replaced, and reduce the diagnosis time during a service call. This leads to reduced machine service hours. This also improves initial print quality and customer satisfaction by insuring that the transfer nips are optimized on the manufacturing line. The embodiments herein therefore improve image quality and customer satisfaction. The embodiments herein enable automated machine self-diagnosis and self-repair (assuming variable nip pressure actuators are designed into the printer). In this way the embodiments herein improve image quality and image quality robustness. This contributes to reduced unscheduled maintenance requests and reduces run cost by reducing service calls for "uneven or non-uniform images." The embodiments herein thereby improve printer productivity by increasing uptime.

The embodiments herein have been described within the context of a tandem IBT marking architecture, and have focused on the mitigation of various defects (e.g., the retransfer smile defect). However, as would be understood by those ordinarily skilled in the art, the embodiments herein can be used within a larger automated or semi-automated diagnostic routine to identify the subsystem(s) responsible for specific print quality defects.

Thus, as shown above the embodiments herein provide an automated method to accurately measure and assess the transfer field uniformity in all the transfer nips in a marking engine. While this approach is useful in any marking engine, it is particularly advantageous in tandem IBT engines that could contain large numbers of color engine and transfer nips. Modular overprint architectures employing two marking engines may have twice as many transfer nips. The automated transfer field uniformity map of embodiments herein can be used to insure optimal transfer nip performance for each engine prior to release from manufacturing. The embodiments significantly reduce service diagnostic time and improve diagnostic accuracy in the field. The embodiments enable remote engine self-diagnosis and service call initiation. The embodiments enable real-time feed-forward actuator adjustment within the engine to improve transfer field uniformity. The embodiments enable closed loop transfer field uniformity control within the engine.

The embodiments herein can be used with any kind of transfer nip technology, including: conformable biased transfer nips (biased transfer rollers, biased transfer belts (BTBs), etc.), corotron and dicorotron transfer nips, corotron/dicorotron transfer nip employing transfer assist blades, etc. The embodiments herein can help identify and mitigate a host of print quality defects associated with non-uniform transfer including: retransfer smile, materials properties variation with a biased transfer member (bias transfer rolls or biased transfer belts), hot spots on the coronodes of corotrons and dicorotrons, coronode arcing to shields, transfer induced mottle, transfer induced toner disturbances due to arcing (e.g., the Maru-hanko defect and fireworks), etc.

The advantages of the embodiments herein include improved image quality, more robust image quality (with respect to noise factors), rapid and accurate automated failure mode diagnostics in the field and on the manufacturing line, reduced run cost and service cost, reduced unscheduled maintenance rate, especially for "uneven or non-uniform image", reduced service time and machine service time), improved customer satisfaction, and improved machine productivity through increased uptime.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

operating a printing device in a standard operating mode;

while operating said printing device in said standard operating mode, supplying a standard transfer field to a first marking material transfer device of said printing device;

operating said printing device in a test mode;

while operating said printing device in said test mode, detecting and then comparing a spatial distribution of marking material transferred to or from a recipient surface against a predetermined standard; and while operating said printing device in said test mode, if an actual amount of marking material transferred to or from said recipient surface is different than said predetermined standard, identifying said first marking material transfer device as being a potential source of printing defects.

2. The method according to claim 1, further comprising while operating said printing device in said test mode, supplying a changed transfer field to said first marking material transfer device, said changed transfer field being different than said standard transfer field.

3. The method according to claim 2, said changed transfer field comprising a field sufficiently reduced to amplify the impact of electrical field inconsistencies within said marking material transfer device.

4. The method according to claim 1, said comparing comprising detecting said actual amount of marking material transferred using an optical scanner.

5. The method according to claim 1, said recipient surface comprising one of a transfer belt and a sheet of print media.

6. A method comprising:

operating a printing device in a standard operating mode;

while operating said printing device in said standard operating mode, supplying a standard transfer field to a first marking material transfer device of said printing device;

operating said printing device in a test mode;

while operating said printing device in said test mode, disabling operations of other marking material transfer devices of said printing device;

while operating said printing device in said test mode, detecting and then comparing a spatial distribution of marking material transferred to or from a recipient surface to which said first marking material transfer device transfers said marking material against a predetermined standard;

while operating said printing device in said test mode, if an actual amount of marking material transferred to or from said recipient surface is different than said predetermined standard, identifying said first marking material transfer device as being a potential source of printing defects; and while operating said printing device in said test mode, repeating said supplying of said standard transfer field, said disabling, said comparing, and said identifying individually for each of said other marking material transfer devices to identify ones of said other marking material transfer devices as being potential sources of printing defects.

7. The method according to claim 6, further comprising while operating said printing device in said test mode, supplying a changed transfer field to said first marking material transfer device, said changed transfer field being different than said standard transfer field.

8. The method according to claim 7, said changed transfer field comprising a field sufficiently reduced to amplify the impact of electrical field inconsistencies within said marking material transfer device.

9. The method according to claim 6, said comparing comprising detecting said actual amount of marking material transferred using an optical scanner.

10. The method according to claim 6, said recipient surface comprising one of a transfer belt and a sheet of print media.

11. A printing device comprising:

a processor;

a marking material supply operatively connected to said processor, said marking material supply maintains marking material;

a media sheet supply operatively connected to said processor, said media sheet supply maintains at least one media sheet to which said marking material will be transferred; and a marking material transfer device operatively connected to said processor, said marking material transfer device directly or indirectly transfers said marking material to said media sheet, said processor controls said printing device to operate in a standard operating mode, while operating said printing device in said standard operating mode, said processor supplies a standard transfer field to said marking material transfer device, said processor controls said printing device to operate in a test mode, while operating said printing device in said test mode, said processor detects and then compares a spatial distribution of marking material transferred to or from a recipient surface against a predetermined standard, while operating said printing device in said test mode, if an actual amount of marking material transferred to or from said recipient surface is different than said predetermined standard, said processor identifies said marking material transfer device as being a potential source of printing defects, and while operating said printing device in said test mode, said processor repeats said supplying of said standard transfer field, said comparing, and said identifying individually for each of said other ones of marking material transfer devices to identify said other ones of said marking material transfer devices as being potential sources of printing defects.

12. The printing device according to claim 11, while operating said printing device in said test mode, said processor supplies a changed transfer field to said marking material transfer device, said changed transfer field being different than said standard transfer field.

13. The printing device according to claim 12, a changed transfer field comprising a field sufficiently reduced to amplify the impact of electrical field inconsistencies within said marking material transfer device.

14. The printing device according to claim 11, said comparing comprising said processor detecting said actual amount of marking material transferred using an optical scanner.

15. The printing device according to claim 11, said recipient surface comprising one of a transfer belt and said media sheet.

16. A printing device comprising:

a processor;

a marking material supply operatively connected to said processor, said marking material supply maintains marking material;

a media sheet supply operatively connected to said processor, said media sheet supply maintains at least one media sheet to which said marking material will be transferred; and a plurality of marking material transfer devices operatively connected to said processor, said marking material transfer devices directly or indirectly transfer said marking material to said media sheet, said processor controls said printing device to operate in a standard operating mode, while operating said printing device in said standard operating mode, said processor supplies a standard transfer field to a first marking material transfer device of said marking material devices, said processor controls said printing device to operate in a test mode, while operating said printing device in said test mode, said processor disables operations of other ones of said marking material transfer devices, while operating said printing device in said test mode, said processor detects and then compares a spatial distribution of marking material transferred to or from a recipient surface to which said first marking material transfer device transfers said marking material against a predetermined standard, while operating said printing device in said test mode, if an actual amount of marking material transferred to or from said recipient surface is different than said predetermined standard, said processor identifies said first marking material transfer device as being a potential source of printing defects, and while operating said printing device in said test mode, said processor repeats said supplying of said standard transfer field, said disabling, said comparing, and said identifying individually for each of said other ones of marking material transfer devices to identify said other ones of said marking material transfer devices as being potential sources of printing defects.

17. The printing device according to claim 16, while operating said printing device in said test mode, said processor supplies a changed transfer field to said first marking material transfer device, said changed transfer field being less than or more than said standard transfer field.

18. The printing device according to claim 17, said changed transfer field comprising a field sufficiently reduced to amplify the impact of electrical field inconsistencies within said marking material transfer device.

19. The printing device according to claim 16, said comparing comprising said processor detecting said actual amount of marking material transferred using an optical scanner.

20. The printing device according to claim 16, said recipient surface comprising one of a transfer belt and said media sheet.

* * * * *